US005892168A

United States Patent [19]

Donohoe

[11] Patent Number: 5,892,168

[45] Date of Patent: Apr. 6, 1999

[54] DRUM HEAD WITH FLOATING MUFFLING RING

[75] Inventor: David G. Donohoe, Springville, Calif.

[73] Assignee: Aquarian Accessories Corporation, Anahein, Calif.

[21] Appl. No.: 720,196

[22] Filed: Sep. 25, 1996

[51] Int. Cl.[6] ..... G10D 13/02

[52] U.S. Cl. ..... 84/411 M

[58] Field of Search ..... 84/411 M, 414, 84/411 P

*Primary Examiner*—William M. Shoop, Jr.
*Assistant Examiner*—Jeffrey W. Donels
*Attorney, Agent, or Firm*—William L. Chapin

[57] ABSTRACT

An improved drumhead construction for drums of the type used in percussion sections of bands and orchestras utilizes a sound absorbing muffling ring attached to the drumhead to minimize the amplitude and duration of undesirable resonance sounds or over-ringing. The muffling ring according to the present invention includes a flat annular ring having a sound absorbing surface such as felt adjacent to the inner, or non-battered surface of a drum head membrane. The sound absorbing ring is attached to the drumhead membrane only at certain locations of the ring, thereby permitting unattached portions of the ring to float with respect to the drumhead membrane, away from the membrane in response to initial brisk movement of the membrane in response to a drum beat, thereby minimizing attenuation of initial drumhead membrane vibrations which produce desired sharp attack sounds. The muffling ring includes means for resiliently urging the sound absorbing portion thereof back into contact with the drumhead membrane, thereby dampening the amplitude and duration of undesired resonances in the drumhead. In a preferred embodiment, a second annular ring-shaped lamination made of an elastic material such as fibreboard is attached to the inner surface of the sound absorbing ring lamination, and urges the sound absorbing lamination into contact with the membrane. The muffling ring is preferably attached to the inner, or non-battered surface of the batter membrane of a drumhead. In drums provided with a second, resonating drumhead, a muffling ring may be attached to the resonating drumhead instead of or in addition to the muffling ring attached to the batter drumhead.

26 Claims, 3 Drawing Sheets

DRUM HEAD WITH FLOATING MUFFLING RING

BACKGROUND OF THE INVENTION

A. Field of the Invention

The present invention relates to percussion musical instruments, specifically drums. More particularly, the invention relates to a drumhead construction having improved acoustical characteristics.

B. Description of Background Art

A variety of drums are used by orchestras, bands and other such musical groups Drum types commonly used by musicians include kettle drums, also known as tympani, base or kick drums, and snare drums. All of these drums include one or two heads, each having a membrane made of an animal skin or synthetic polymer sheet. The membrane is held in tension over the open end of a hollow cylindrical shell, the outer surface of the membrane being used as a striking or batter surface which is impacted by a drumstick, mallet or hand, causing the drumhead and air column within the shell to vibrate at audible frequencies.

The fundamental vibration frequency, harmonics or overtones of the fundamental vibration frequency, and decay or dampening time of sounds produced by a drum are determined primarily by characteristic or normal vibration modes excited in the drumhead membrane when it is struck by a drumstick, mallet, hand or other object. Vibration frequencies and resonance or dampening characteristics of the drumhead vibration modes are in turn determined in part by the diameter, weight per unit area, compliance or elasticity, and other such properties of the drumhead membrane. Drumhead vibration frequencies are also determined by the amount of tension exerted on the drumhead membrane. This tension is usually controlled by means of an adjustable hoop attached to the drumhead membrane and clamped to the shell. Therefore, producing desired tones from a drum requires that tension in the drumhead be accurately and uniformly adjusted by the drum hoop tensioning means.

Since the required tension is often times quite large, polyester film, because of its high strength, resistance to weather changes, consistency and tone quality, is the preferred material for the manufacture of drumhead membranes. Unfortunately, polyester films such as MYLAR™, when struck with a drumstick, produce undesirable high-frequency resonant overtones which may have a substantially long decay time. The task of reducing or eliminating undesirable overtones creates substantial problems in tuning drumheads, and in the "miking" (picking up sounds with a microphone). amplification and recording of drum sounds produced in a concert hall or other such venue.

In an effort to decrease the amplitude of undesirable high frequency drum resonances, and/or to dampen or decrease their resonant decay times, drummers and sound engineers have heretofore resorted to a variety of less than optimum methods.

One make-shift approach to dampening undesirable drumhead overtones consists of placing or attaching pieces of sound deadening material on the outside surface of a drumhead. Facial tissue, felt, paper towels and cloth have been used for this purpose, but the results achieved are inconsistent at best. Also, from an aesthetic point of view, pieces of paper or cloth taped to a drumhead are very unsightly, for both live performances and televised concerts.

Taping towels, paper or cloth to one area of a drumhead to reduce the amplitude and duration of undesirable overtones also has the unwanted consequences of over-muffling one area of the drumhead, while having little effect on the remainder of the head. This results in the production of a somewhat unbalanced set of frequencies, owing to the fact that the dampening of overtones is confined to a localized area of the drumhead contacted by the dampening materials. A loss of overall tone quality and musical effect is the usual result. Also, the drummer is presented with the problem of avoiding the muffled area when striking the drumhead. This problem is aggravated when individual drums of a large set of drums, sometimes as many as ten, must be struck in rapid succession.

Another approach to muffling drumhead overtones, used primarily on base drums having an open end, consists of placing a pillow or blanket inside the drum, in contact with the inside surface of the drumhead. At best, this method results in unpredictable or weird sounds to be produced by the drum.

In an effort to solve the harmonic ringing problem, some manufacturers of drumheads have constructed laminated drumheads having multiple plies. An inherent problem with such drumheads is the dull, over-muffled sound produced by the drums. Also, it is difficult to maintain the same relative tension in the two plies. The result is an inconsistent product.

Other approaches to drumhead overtone dampening have included laminating foam or rubber rings to an inner surface in the drumhead. However, the weight of such materials prevents the drumhead from vibrating in a desired fashion. Moreover, the tone quality and musical effect are degraded by such muffling rings.

Since no completely satisfactory solution to the problem of drumhead ringing control existed heretofore, the present invention was conceived of to solve that problem.

OBJECTS OF THE INVENTION

An object of the present invention is to provide an improved drum construction employing drumheads in which undesirable resonant frequencies or over-ringing produced when the drumhead is struck, are reduced in amplitude and/or duration.

Another object of the invention is to provide a drumhead construction in which over-ringing is reduced, without a corresponding attenuation of sharp initial attack sounds produced by the drum.

Another object of the invention is to provide a drumhead in which dampening of overtones is initially small, and subsequently larger.

Another object of the invention is to provide a drumhead having an overtone dampening factor that varies as a function of time after the drumhead is struck.

Another object of the invention is to provide a drumhead fitted with an acoustic muffling ring having a time-variable dampening factor for overtones.

Another object of the invention is to provide a drumhead having a floating acoustic muffling ring which has an initially small dampening factor for ringing sounds produced by the vibrating drumhead, followed in time by a larger dampening factor.

Various other objects and advantages of the present invention, and its most novel features, will become apparent to those skilled in the art by perusing the accompanying specifications, drawings and claims.

It is to be understood that although the invention disclosed herein is fully capable of achieving the objects and providing the advantages described, the characteristics of the invention described herein are merely illustrative of the preferred embodiment. Accordingly, I do not intend that the scope of my exclusive rights and privileges in the invention by limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends an improved drumhead construction which provides greater control of the amplitude and duration of resonant vibration overtones produced in response to striking the drumhead.

According to the present invention, one or both heads of a drum are provided with an acoustic harmonic dampening ring having a novel "floating" construction. The novel acoustic dampening ring according to the present invention includes a flat annular ring made of a flexible material and attached to the inner flat surface of a drumhead adjacent the air column within the hollow cylindrical shell of the drum. The dampening ring, which is preferably made of a sound absorbing material, is preferably located concentrically with respect to the drumhead, and is attached to the surface of the drumhead only at certain locations of the dampening ring, thereby permitting other, unattached portions of the dampening ring to "float." When the drumhead is struck, movement of the drumhead causes the floating portions of the dampening or muffling ring to be displaced resiliently away from the moving drumhead. Thus, during the initial relatively large movement of the drumhead in response to being struck, only those portions of the dampening ring that are attached to the drumhead have a dampening effect on sounds produced. Therefore, the sharp attack sounds at the leading edge of the sound vibration wave produced by the drum are affected minimally by the presence of the novel acoustic muffling ring according to the present invention. However, after the initial large displacement of the drumhead, and the resilient displacement away from the drumhead of the floating portion of the muffling ring, the floating portion of the ring springs resiliently back into contact with the inner surface of the drumhead. In this position the muffling ring is effective in decreasing the amplitude and duration of vibration overtones, thus reducing over-ringing of the drumhead.

The preferred embodiment of the floating acoustic muffling ring according to the present invention has two laminations or plies. The first ply, in contact with the inner surface of the drumhead, is made of a sound deadening or absorbing material such as felt. Materials such as felt that have good sound absorption properties are typically not very elastic. Thus, if the muffling ring according to the present invention were made of a single ply of felt, or other such material, the ring would not spring back into contact with the drumhead after the initial displacement away from the head, and would therefore be ineffective in dampening overtones. Accordingly, the floating acoustic muffling ring according to the present invention includes a second ply made of a thin sheet of material having greater elasticity than felt. In one embodiment of the floating acoustic muffling ring according to the present invention, the second ply, which functions as an elastic backing plate, is made of fiberboard. In the preferred embodiment, the first, sound absorbing ply of the acoustic muffling ring is attached to the inner surface of a drumhead by an adhesive region located on a circle near the outer circumference of the ring, allowing the smaller diameter portions of the ring to float with respect to the drumhead. Similarly, the outer ply or backing plate is attached to the outer surface of the sound absorbing ply by a ring-shaped layer of adhesive located near the outer diameter of the backing ring, allowing the smaller diameter portion of the backing plate to float. Either o both adhesive rings may be continuous or consist of circumferentially spaced apart adhesive spots.

DETAILED DESCRIPTION OF THE PREFERRED EMBODIMENTS

FIGS. 1–5 illustrate drums in which one or more of the drumheads thereof are provided with a novel floating muffling ring according to the present invention.

Figure 1:
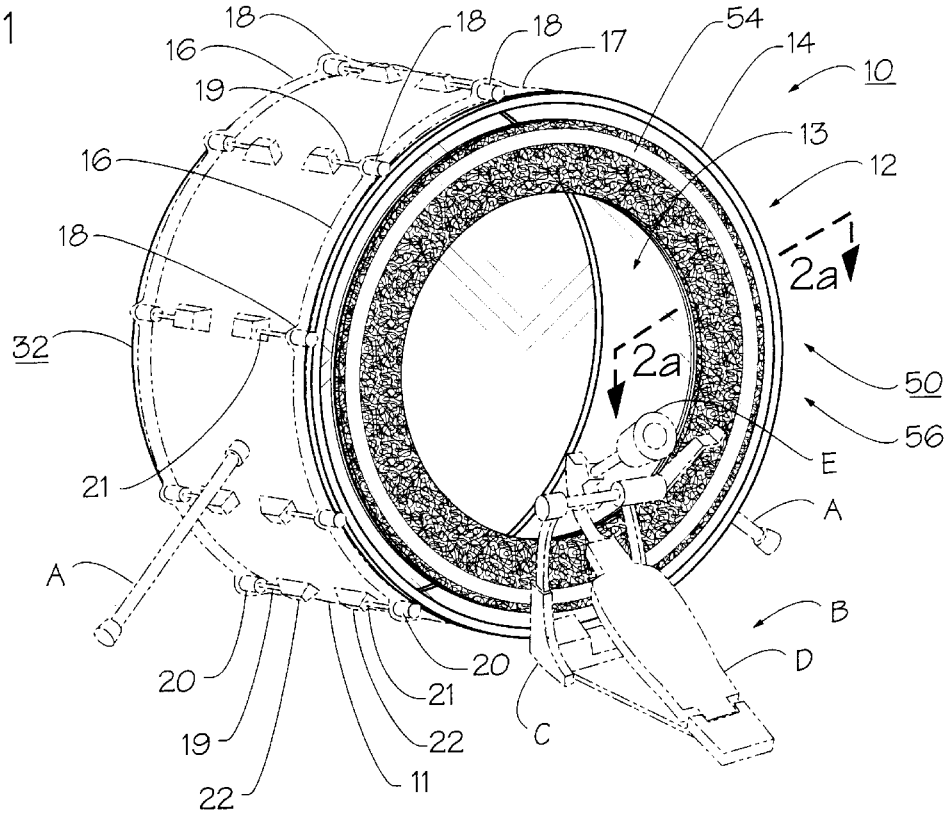
FIG. 1 is a perspective view of a base drum including a drumhead provided with a floating muffling ring according to the present invention.

Referring now to FIG. 1, a base drum 10 is shown, the drum including a hollow cylindrical shell 11, and a first, batter, head 12, which is intended to be struck to produce sounds. Head 12 includes a circular membrane 13 mounted peripherally within a tensioning hoop 14. Membrane 13 is held in tensioned contact with an annular end wall 15 of cylindrical shell 11 by means of a counter-tensioning hoop 16. Counter tensioning hoop 16 has a radially outwardly protruding lower flange 17 provided with a plurality of circumferentially spaced apart perforations 18, each insertably receiving an axially inwardly protruding tension rod 19 having a slotted head 20. Each tension rod 20 has an externally threaded inner end 21 which is threadingly received within a threaded bore of a lug 22, which is attached to shell 11 of drum 10.

As shown in FIG. 1, base drum 10 may include a pair of support legs or spurs A, and may also be provided with a pedal assembly B, including a pedal support stand C, a foot pedal D, and a mallet E pivotably operable by the foot pedal to impact drumhead 12.

As is also shown in FIG. 1, drum 10 may be provided with an optional resonating head 32, having elements 33–42 that are exact counterparts of elements 13–22 of batter head 12 described above. The function of resonating head 32 is to provide a closed boundary for the cylindrical air column within shell 11 of drum 10, and to vibrate sympathetically, or resonate, in response to sound waves produced when the batter head is struck.

Figure 2A:
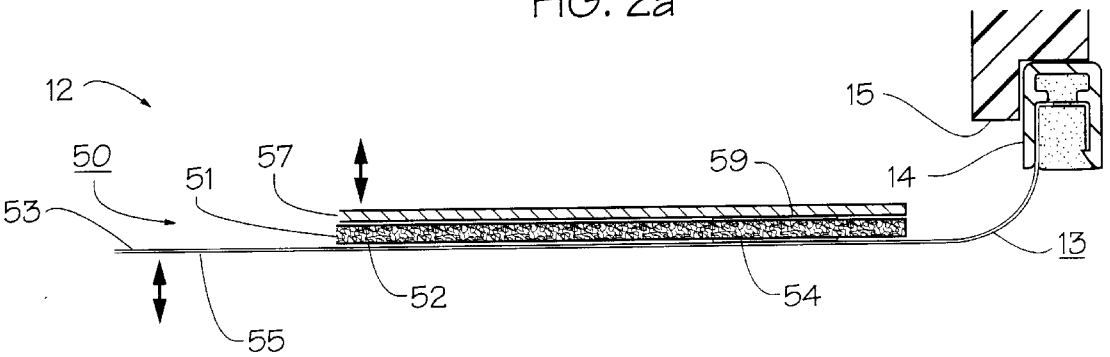
FIG. 2A is a fragmentary transverse sectional view of a drumhead of FIG. 1, taken along line 2A—2A.
Figure 2B:
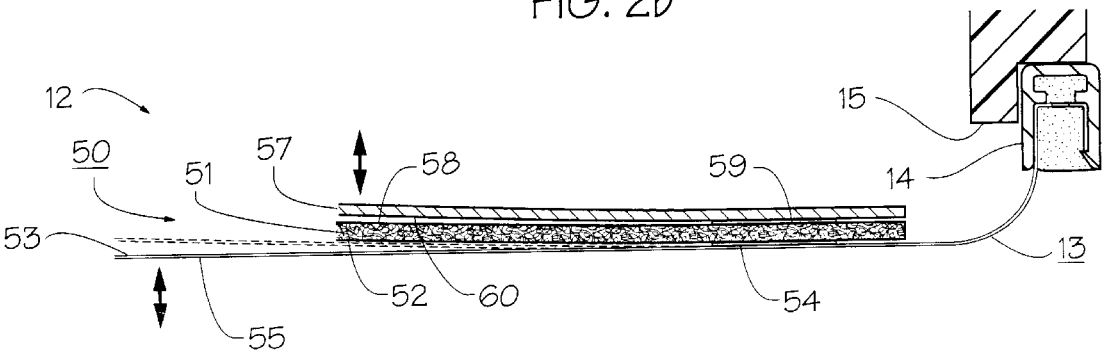
FIG. 2B is a view similar to FIG. 2A, but showing free ends of the floating muffling ring displaced from the drumhead membrane in response to vibration of the drumhead.

Referring now to FIGS. 2 and 3 in addition to FIG. 1, a novel floating muffling ring 50 according to the present invention will be described.

As shown in FIGS. 1–3, floating muffling ring 50 may be seen to include a flat annular upper or inner lamination 51 attached to the inner surface of batter drumhead 12. As may be seen best by referring to FIG. 3, lamination 51 of muffling ring 50 has an outer diameter slightly less than the outer diameter of drumhead 12, and is located concentrically therewith. Preferably, the ratio of the outer diameter of inner lamination 51 to the outer diameter of membrane 13 of drumhead 12 lies in the approximate range of 0.900+0.1,−0.4. The ratio of the width of outer lamination 51 to the outer diameter of membrane 13 preferably lies in the approximate range of 0.275±0.100.

Figure 3B:
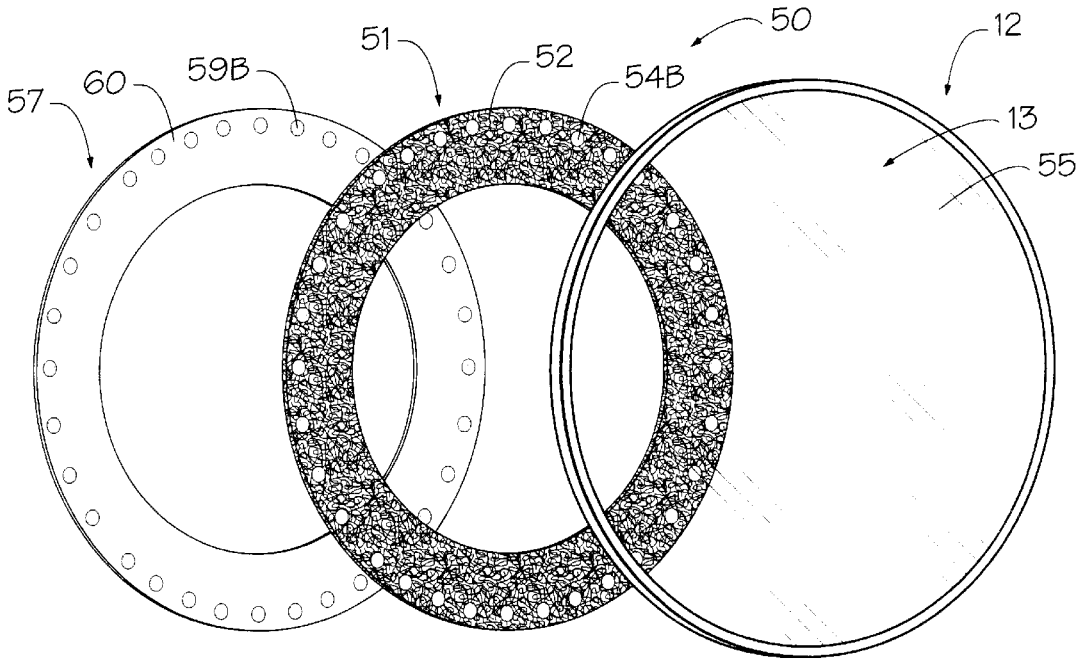
FIG. 3B is a view similar to that of FIG. 3A, but showing a modification of the floating muffling ring of FIG. 3A, having a modified adhesive layer.
Figure 3A:
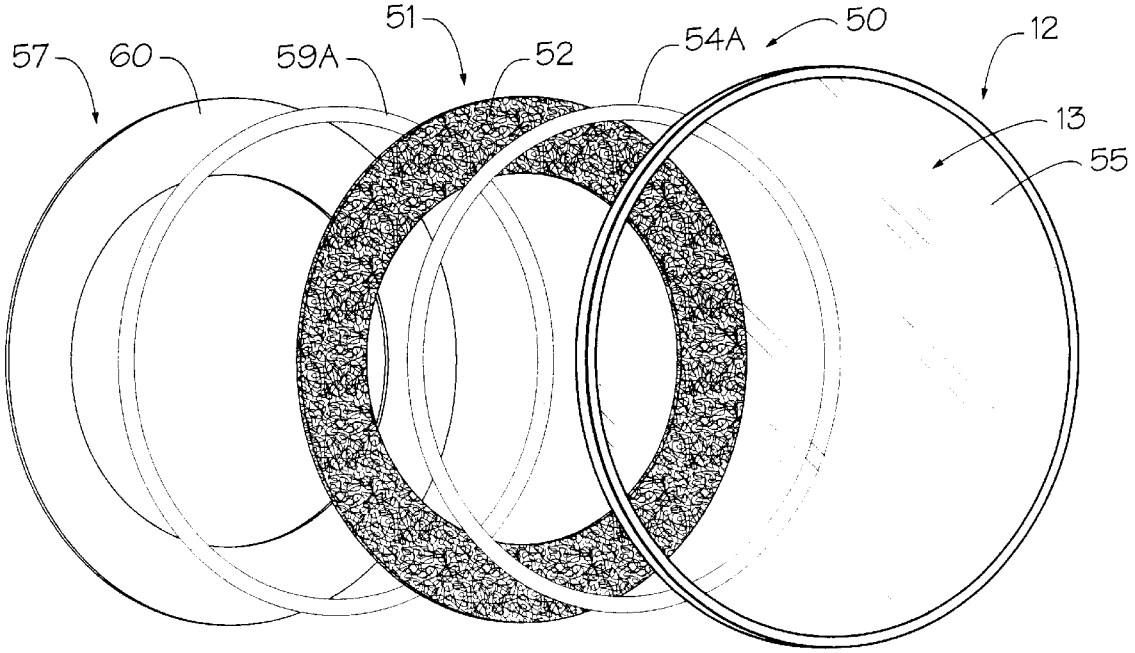
FIG. 3A is an exploded upper perspective view of the floating muffling ring and drumhead of FIGS. 1–2B.
Figure 4:
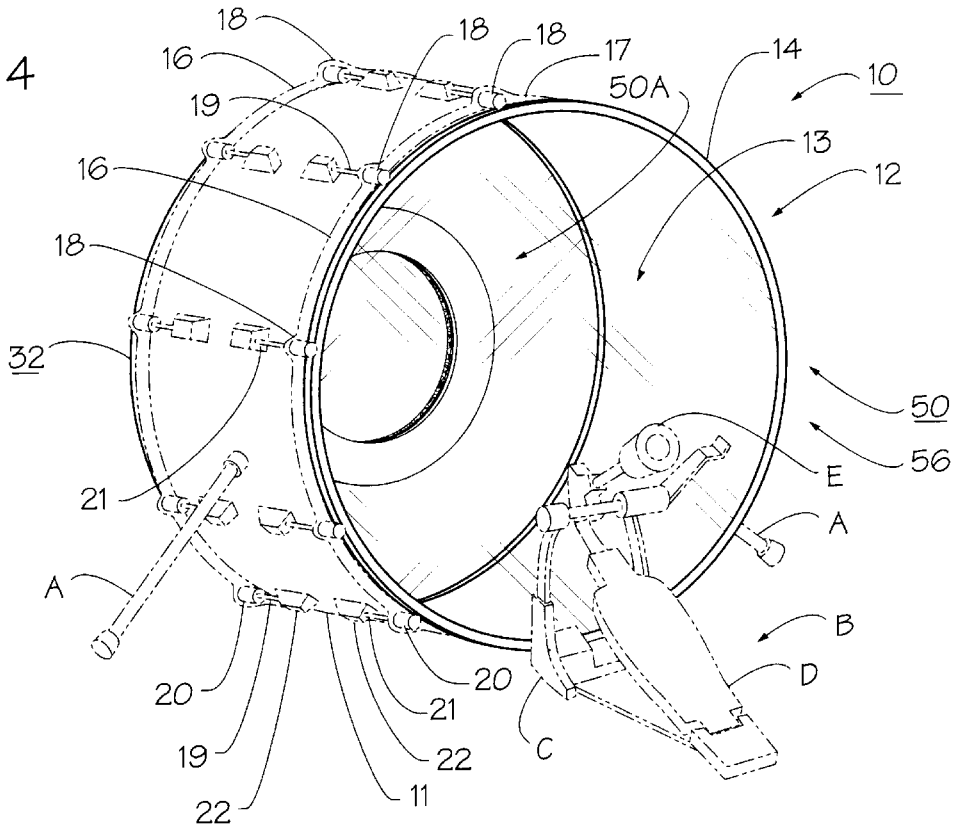
FIG. 4 is a perspective view of a second embodiment of a drum according to the present invention, in which a floating muffling ring is attached to the non-battered or resonating drumhead of the drum.

Referring now to FIG. 2 in conjunction with FIG. 3, inner surface 52 of muffling ring inner lamination 51 may be seen to be attached to the inner surface 53 of drumhead 12, preferable by a layer 54 of an adhesive such as contact cement. As shown in FIG. 2, adhesive layer 54 is located near the outer periphery of muffling ring inner lamination 51, allowing the inner annular portion of the inner lamination to move independently of, or "float," with respect to the adjacent surface 53 of drumhead 12. Thus, adhesive layer 54 is confined to an annular ring-shaped region near the outer periphery of muffling ring inner lamination 51, between inner surface 52 of the upper lamination ring and inner surface 53 of the drumhead. Within that region, adhesive layer 54 may be in the form of a continuous ring 54A as shown in FIG. 3A, or in the form of a segmented ring of circumferentially spaced apart blobs 54B of adhesive, as shown in FIG. 3B. In either case, adhesive layer 54 may be applied as a semi-liquid, or as a continuous ring or ring of dots made of double-stick tape.

Inner lamination 51 of muffling ring 50 is made of a material that has good sound absorption or dampening characteristics, at least in the inner surface 52 of the lamination. Thus, inner lamination 51 of floating muffling ring 50 is preferably made of a soft, sound absorbing material such as felt. In tests made by the present inventor, felt supplied by Felters Company, Santa Ana, Calif., and having a thickness of about ⅛ inch was used with good results. Preferably, the thickness of felt inner lamination 51 would lie in the approximate range of 1/32 inch to 3/16 inch for base drums.

When the outer surface 55 of batter drumhead membrane 13 is struck by a drumstick or mallet, inner surface 53 of the membrane is displaced rapidly inwards towards the air column 56 within shell 11 of drum 10. Therefore, inner lamination 51 of floating muffling ring 50, which is attached by adhesive layer 54 to inner surface 53 of membrane 13, also moves rapidly inward. However, since the floating inner annular region of inner lamination 51 is not attached to membrane 13, when the membrane moves outwards elastically, the inertia of the upper lamination prevents it from moving outwards in concert with the membrane. Thus, the inner layer of the floating portion of lamination 51, which is preferably made of a sound absorbing material such as felt, which displays very little elasticity, tends to remain spaced apart from inner surface 53 of drumhead membrane. In this position, inner lamination 51 would be ineffective in producing the desired dampening of ringing overtones of drumhead membrane 12. Therefore, the preferred embodiment of floating drumhead muffling ring 50 includes means for resiliently urging sound absorbing inner lamination 51 back into sound dampening contact with inner surface 53 of drumhead membrane 13, as will now be described.

Referring now to FIGS. 2 and 3, a preferred embodiment of drumhead muffling ring 50 may be seen to include a second, lower or outer, backing plate lamination 57. As shown in FIGS. 2 and 3, outer, backing plate lamination 57 has a flat annular shape, and is attached to the lower or outer surface 58 of inner lamination 51 Outer, backing plate lamination 57 preferably has an outer diameter of approximately the same size as the outer diameter of inner lamination 51, and is preferably concentrically located with respect to the inner lamination. In the preferred embodiment, outer lamination 57 also has an inner diameter of the same size as the inner diameter of inner annular lamination 51. With this size equality, both inner and outer circumferential edges of the inner and outer laminations are axially aligned.

Referring now to FIG. 2 in conjunction with FIG. 3, outer lamination 57 may be seen to be attached to the outer surface of inner lamination 51, preferably by layer 59 of an adhesive such as contact cement. As shown in FIG. 2, adhesive layer 59 is located near the outer periphery of muffling ring outer lamination 57, allowing the inner annular portion of the outer lamination to move independently of, or "float" with respect to the outer surface 58 of inner lamination 51. Thus adhesive layer 59 is confined to an annular ring-shaped region near the outer periphery of muffling ring outer lamination 57, between inner surface 60 of the outer lamination ring and the outer surface 58 of inner lamination 51. Within that region, adhesive layer 59 may be in the form of continuous ring 59A, as shown in FIG. 3A, or in the form of a segmentary ring of circumferentially spaced apart blobs 59B, as shown in FIG. 3B. In either case, adhesive layer 59 may be applied as a semi-liquid, or as a continuous ring or ring of dots made of double-stick tape.

The function of outer, backing plate lamination 57 of muffling ring 50 is to serve as an elastic backing plate that urges sound absorbing inner lamination 51 back into sound deadening contact with inner surface 53 of drumhead membrane 13, after its initial displacement from the membrane in response to a drum beat. Thus, outer lamination 57 of floating muffling ring 50 is preferably made of a thin sheet of light, reasonably elastic material, such as fiber board. In tests made by the present inventor, 0.024 inch thick white chip board supplied by the Gleason Industrial Company, 5033 W. 147th St., Hawthorne, Calif. 90251, and having a thickness of about 0.024 inch, was used with good results. Preferably, the thickness of outer, backing plate lamination 57 would be in the approximate range of 0.010 inch to 0.040 inch for a base drum or kick drum.

In some musical applications, it may be desirable to dampen over-ringing of the non-battered or resonating drumhead of a drum, while leaving the batter head undampened. Thus, in a second embodiment of the present invention, shown in FIG. 4, a novel floating muffling ring 50A according to the present invention is attached to the resonating head 32 of a drum 10A. When attached to a resonating head rather than a batter head, the ratio of the outer diameter of the muffling ring to the outer diameter of the resonating head membrane is preferably smaller than the corresponding ratio for a batter head, because the resonating head experiences smaller vibration amplitudes than the batter head. Thus, for a resonating head, the ratio of the outer diameter of the floating muffling ring to the outer diameter of the resonating drumhead membrane would preferable be in the approximate range of 0.525±0.200. Also, for resonating head 32 a preferred range of the ratio of the width of muffling ring 50A to the outer diameter of the resonating head membrane would be about 0.175±0.1.

Figure 5:
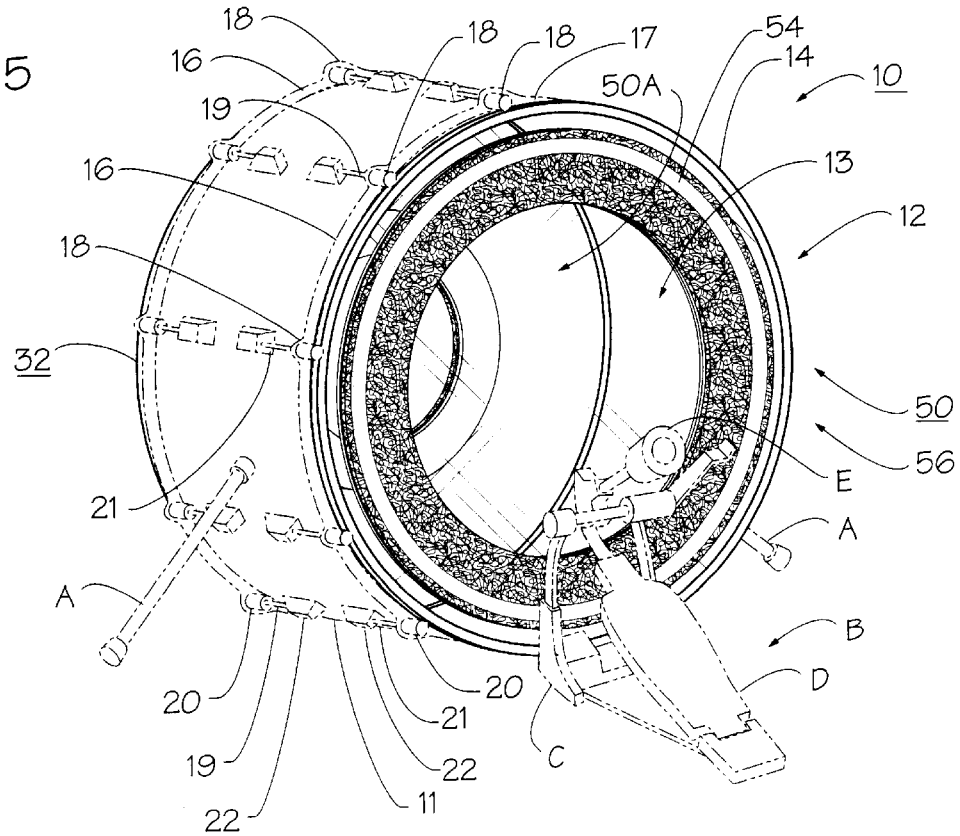
FIG. 5 is a perspective view of a third embodiment of a drum according to the present invention, in which floating muffling rings are attached to both batter and resonating drumheads.

FIG. 5 illustrates a third embodiment of a drum according to the present invention, in which floating muffling rings are attached to both batter and resonating drumheads. In that embodiment, muffling rings according to the present invention, as described above, are attached to both the batter head and resonating head.

What is claimed is:

1. An improved drum for use in musical performances, said drum having a hollow cylindrical shell and including at least a first drumhead including a membrane held in tension over an open transverse end of said shell, the improvement comprising muffling means for dampening or muffling vibration resonances produced when said drumhead is struck, said muffling means including a sound absorbing member attached to a surface of said drumhead membrane, said sound absorbing member having a first, inner sound absorbing surface at least a portion of which is resiliently movable away from contact with said surface of said membrane to a position not contacting said surface of said membrane upon initial axial movement of said membrane, and resiliently movable back into contact with said membrane surface after said initial axial movement of said membrane, whereby said sound absorbing membrane causes little attenuation of sounds initially produced by vibration of said drumhead membrane, and said absorbing member causes greater attenuation of later occurring sounds.

2. The drum of claim I wherein said sound absorbing member of said muffling means is further defined as being flexibly attached at discrete inner surface locations thereof to a surface of said membrane, the unattached portions thereof being permitted to move away from contact with said membrane.

3. The drum of claim 2 wherein said muffling means is further defined as including return means for resiliently urging said unattached portions of said sound absorbing member into contact with said membrane after initial axial displacement therefrom.

4. The drum of claim 3 wherein said return means is further defined as being a resilient backing plate member located at a second, outer surface of said sound absorbing member.

5. The drum of claim 4 wherein said resilient backing plate member is further defined a being attached to said outer surface of said sound absorbing member at discrete outer surface locations thereof, the unattached portions of said resilient member thereby being permitted to move away from contact with said sound absorbing member.

6. The drum of claim 1 wherein said muffing means is further defined as having an annular plan-view shape.

7. The drum of claim 6 wherein said muffling means is further defined as being located concentrically with respect to said membrane.

8. The drum of claim 1 wherein said drumhead to which said muffling means are attached is further defined as a batter drumhead.

9. The drum of claim 1 further including a second resonating, drumhead.

10. The drum of claim 9 wherein said drumhead to which said muffling means is attached is further defined as said resonating drumhead.

11. The drum of claim 10 further including second muffling means attached to said batter drumhead thereof.

12. An improved drumhead for musical drums comprising a membrane held in a circular tensioning hoop adapted to fit over the transverse end of a hollow cylindrically-shaped drumhead, said improvement comprising an annular-shaped muffling ring for acoustical dampening attached to said drumhead, said muffling ring having in plan view an annular shape and comprising at least a first generally flat inner lamination having a first, inner annular sound absorbing surface, said inner lamination being attached to a surface of said membrane, said sound absorbing inner surface resiliently contacting said surface of said membrane and movable away from contact with said membrane surface upon initial axial movement of said membrane to a position not contacting said membrane surface in response to a drum beat, and resilient movable back, into contact with said membrane surface after said initial axis movement of said membrane, whereby said sound absorbing surface causes little attenuation of sounds initially produced by vibration of said drumhead membrane, and greater attenuation of later occurring sounds.

13. The drumhead of claim 12 wherein said first, inner lamination of said muffling ring is further defined as being attached to said surface of said membrane only at discrete inner surface attachment points of said inner surface of said first inner lamination, thereby permitting unattached portions of said first lamination to move away from and towards said membrane surface.

14. The drumhead of claim 13 wherein said discrete inner surface attachment points are further defined as being located concentrically with respect to said muffling ring.

15. The drumhead of claim 13 wherein said discrete inner surface attachment points are further defined as lying on a circle.

16. The drumhead of claim 15 wherein said circle is concentric with said muffling rings.

17. The drumhead of claim 16 wherein said circle is further defined as being located closer to the outer circumferential edge of said muffling ring than to the inner circumferential edge thereof.

18. The drumhead of claim 13 further including a second, outer backing plate lamination located axially outward of said drumhead membrane and said first, inner sound absorbing lamination, said backing plate lamination including means for resiliently urging said first, inner lamination into contact with said membrane.

19. The drumhead of claim 18 wherein said second, outer backing plate lamination is further defined as being attached to a second, outer surface of said inner lamination only at discrete outer surface attachment points thereof, thereby permitting unattached portions of said second, backing plate lamination to move away from and towards said membrane surface.

20. The drumhead of claim 18 wherein said second, backing plate lamination is further defined as being attached to said outer surface of said first lamination only at discrete attachment portions of said second lamination, thereby permitting unattached portions of said second lamination to move away from and towards said inner surface of said membrane.

21. The drumhead of claim 20 wherein said second, backing plate lamination is further defined as having an annular shape.

22. The drumhead of claim 21 wherein said outer surface attachment points are further defined as lying on a circle concentric with said first and second laminations.

23. A floating acoustic muffling device for musical drumheads, said muffling device comprising:

a. a first, generally flat sound absorbing lamination having a first, inner sound absorbing surface, and b. means for resilient urging said sound absorbing inner surface of said first lamination into sound absorbing contact with a surface of a drumhead membrane, said resilient urging means being so constructed as to permit said sound absorbing inner surface of said first lamination to move away from contact with said membrane surface upon initial axial movement of said membrane, and back into contact with said membrane surface after said movement of said membrane.

24. The muffling device of claim 23 wherein said lamination is further defined as having an annular ring-shaped, plan view.

25. The floating acoustic muffling ring of claim 24 wherein said resilient urging means is further defined as being a second, annular plan view, generally flat ring-shaped backing plate ring, at least the outer annular portion of which is made of an elastic material.

26. The floating acoustic muffling ring of claim 25 wherein said backing plate ring is further defined as being attached to a second, outer surface of said first, sound absorbing lamination only at discrete attachment portions of said backing plate ring, thereby permitting unattached portion, of said backing plate ring to move resiliently away from and towards said first lamination.

* * * * *